US005333879A

United States Patent [19]

Barnes

[11] Patent Number: 5,333,879

[45] Date of Patent: Aug. 2, 1994

[54] TARGET BOARD FOR BAG PITCHING GAME

[76] Inventor: Thomas D. Barnes, 1409 Avenue J, Scottsbluff, Nebr. 69361

[21] Appl. No.: 18,548

[22] Filed: Feb. 17, 1993

[51] Int. Cl.[5] ..... A63B 63/02

[52] U.S. Cl. ..... 273/400; 273/409; 273/415

[58] Field of Search ..... 273/398–402, 273/415, 123 R, 108, 127 B, 371

[56] References Cited

U.S. PATENT DOCUMENTS

| | | | |
|---|---|---|---|
| D. 220,349 | 3/1971 | Holt | D34/5 |
| 715,249 | 12/1902 | Dumbar | 273/415 |
| 922,717 | 5/1909 | Parker | 273/415 |
| 1,315,927 | 9/1919 | Geib . | |
| 1,846,412 | 2/1932 | Weinberg | 273/123 R |
| 1,983,044 | 12/1934 | Maynard | 273/125 |
| 1,996,986 | 4/1935 | Weinberg | 273/400 |
| 2,603,489 | 7/1952 | Baumberger | 273/125 R |
| 3,749,401 | 7/1973 | Hayko | 273/95 R |
| 3,749,491 | 7/1973 | Hayko | 273/400 |
| 4,198,050 | 4/1980 | Goldfarb et al. | 273/120 R |
| 4,323,250 | 4/1982 | Lansberry | 273/400 |
| 4,923,201 | 5/1990 | Nichol et al. | 273/415 |
| 4,948,135 | 8/1990 | Follety, Jr. | 273/127 B |
| 5,112,048 | 5/1992 | Kienle | 273/123 R |
| 5,123,656 | 6/1992 | Green | 273/400 |

*Primary Examiner*—Mark S. Graham

*Attorney, Agent, or Firm*—Jacobson, Price, Holman & Stern

[57] ABSTRACT

A target board for use in a bag pitching game which includes a relatively thin, substantially rigid panel having a generally planar upper surface provided with a plurality of upwardly extending, arcuately curved projections extending upwardly from the planar surface to form a plurality of target areas toward which the bag is pitched with the target areas being of different configurations thus introducing different degrees of difficulty with game point scoring values being assigned to the target area depending upon their degree of difficulty. Some of the target areas are assigned positive point values and other of the target areas are assigned negative point values. The target board includes structure which enables the target board to be anchored to a supporting surface and drain holes are provided when used outdoors and a hand hold structure to facilitate the target board being carried or hung vertically from a supporting structure when stored.

5 Claims, 1 Drawing Sheet

TARGET BOARD FOR BAG PITCHING GAME

BACKGROUND OF THE INVENTION

1. Field of the Invention

The present invention generally relates to a target board used when playing a game and more specifically a target board for use in a bag pitching game which utilizes and develops manual dexterity and understanding of various physical laws which determine the trajectory of movement of a pitched bag which is pitched toward the target board mounted on a horizontal supporting surface from a predetermined distance by individual game players. The target board includes a relatively thin, substantially rigid panel having a generally planar upper surface provided with a plurality of upwardly extending, arcuately curved projections or ridges extending upwardly from the planar surface to form a plurality of target areas toward which the bag is pitched with the target areas being of different configurations and at different locations thus introducing different degrees of difficulty with game point scoring values being assigned to the target areas depending upon their degree of difficulty. Some of the target areas are assigned positive point values and other of the target areas are assigned negative point values. The target board includes structure which enables the target board to be anchored to a supporting surface and drain holes are provided when used outdoors and a hand hold structure is provided to facilitate the target board being carried or hung vertically from a supporting structure when stored.

2. Description of the Prior Art

Various types of target boards are known for receiving tossed game pieces by game players in which points are scored by players depending upon the final location of game pieces on the target board as a result of a game player tossing a game piece toward the target board. The following U.S. patents relate to this subject matter.

U.S. Pat. No. Des. No. D,220,349
U.S. Pat. No. 1,315,927
U.S. Pat. No. 1,983,044
U.S. Pat. No. 3,749,401
U.S. Pat. No. 4,198,050

The above patents disclose various types of target boards but do not include target boards with raised arcuate projections having different dimensional characteristics and different locations with respect to the target board to provide a plurality of target areas having different point values associated therewith in accordance with the degree of difficulty encountered in a game player tossing a bag so that it lands in a particular relationship to a target area.

SUMMARY OF THE INVENTION

An object of the present invention is to provide a target board for use in a bag pitching game in which the target board includes upwardly projecting contoured, arcuately curved projections defining a plurality of target areas towards which a flexible bag containing a quantity of sand or other granular material is pitched by a game player in order to score game point in accordance with point values assigned to each individual target area.

Another object of the invention is to provide a target board in accordance with the preceding object in which each projection is in the form of an upwardly extending, arcuately curved ridge or wall having a concave surface facing the area from which a game player pitches a bag toward the target board with the projections serving to retain the pitched bag forwardly of the projection thus facilitating the game player pitching a bag so that it will be retained in front of the concave surface of an upstanding wall or projection in order that a point value assigned to that particular target will be credited to the game player.

A further object of the invention is to provide a target board in accordance with the preceding objects in which the dimensional characteristics of the upstanding walls or projections defining the target areas are differently dimensioned and located at different areas on the game board in order to vary the degree of difficulty in pitching bags in order that they land in association with certain of the target areas with the point values assigned to the target areas increasing or decreasing depending upon the degree of difficulty of a game player pitching a game bag into scoring association with a particular projection or walls.

Still another object of the present invention is to provide a target board which includes apertures to anchor the target board on a supporting surface, apertures to enable drainage of water when the target board is placed outdoors and a hand hold at one end of the target board by which the board can be easily carried or hung from a support in vertical position when stored.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
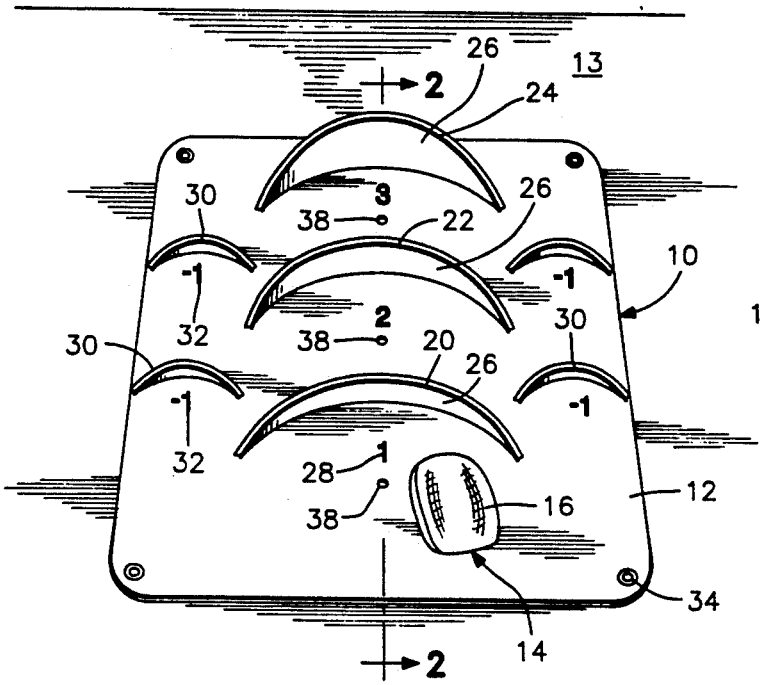
FIG. 1 is a perspective view of the target board of the present invention illustrating its horizontal position when being used with a bag illustrated in typical position on the target board.
Figure 5:
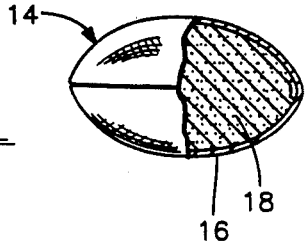
FIG. 5 is an elevational view, with portions broken away, illustrating the construction of the bag for use in playing a bag pitching game.
Figure 2:
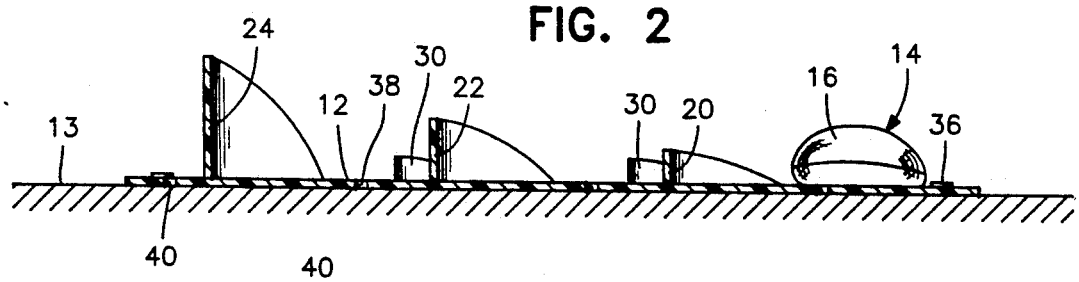
FIG. 2 is a longitudinal, sectional view taken along section line 2—2 on FIG. 1 illustrating the variation in the dimensional characteristics of the upward projection or wall which forms target areas.

Referring now to the drawings, the target board is generally designated by reference numeral 10 and includes a generally rigid rectangular board or panel 12 constructed of relatively thin material such as plastic, wood, metal or the like with the upper surface thereof being substantially flat or planar and provided with any desired background color. As illustrated in FIGS. 1 and 2, the target board 10 is supported on a horizontal supporting surface 13 when in use such as on a patio, deck, carpeted area, ground surface and the like and a player or players pitches a game piece in the form of a bag generally designated by reference numeral 14 toward the target board 10 so that it lands on the upper surface thereof as illustrated in FIGS. 1 and 2. The game bag includes a flexible bag 16 filled with or partially filled with sand 18 or other granular materials such as beans, grain, or the like with the bag having a predetermined size and configuration with a predetermined volume of material therein which may be light or heavy in weight. The game bags are pitched toward the target board 10 from a predetermined distance. If desired, two target boards may be used in a manner similar to horseshoes in which game players may pitch the game bags back and forth between a pair of target boards.

Figure 3:
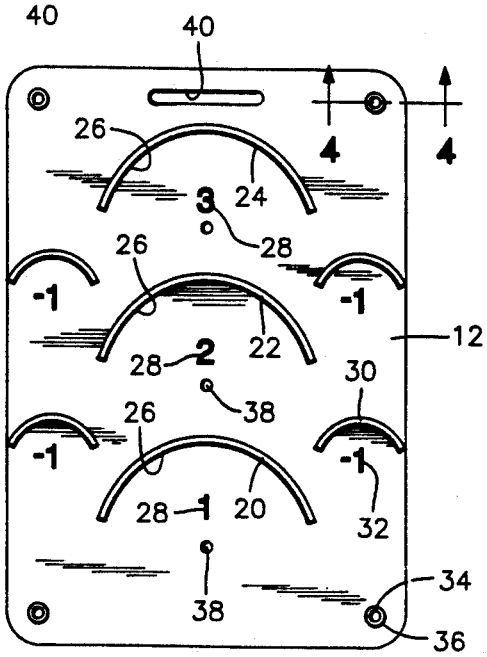
FIG. 3 is a top plan view of the target board.

The target board includes a plurality of longitudinally spaced upwardly extending projections, ridges or walls 20, 22 and 24 oriented generally along a center line of the panel 12 with the target walls 20, 22 and 24 having an arcuate configuration when observed from above as illustrated in FIG. 3 with the concave surface area 26 of each of the targets facing the direction from which the target bags 14 are pitched. Also, as illustrated in FIGS. 1 and 2, the vertical height of the target walls 20, 22 and 24 increase from a shorter height for the target wall 20 to a greater height for the target wall 24 thus varying the degree of difficulty in pitching the bean bag so that it lands in the area adjacent the concave surface 26 of the different target walls. Also, each target wall has an arcuate top edge.

Point values are assigned to the target areas 20, 22 and 24 as indicated by the indicia 28 with the first target area 20 being assigned a point value of 1, the target area 22 having a point value of 2 and the target area 24 having a point value of 3. The point values and the degree of difficulty may vary by varying the relative height and contour of the target walls 20, 22 and 24. Since it is easier to have the target bag land in front of the target wall 20, as compared to having it land in front of the target wall 24, the target wall 24 will have a higher point value assigned.

Positioned adjacent each side edge of the target board 10 is a pair of smaller target areas or walls 30 which are also arcuate in configuration and project upwardly. The target areas 30 are "out of bounds" and have a negative point value as indicated by indicia 32. Thus, if the game bag 14 lands in the target area facing the concave surface of the target walls 30 game points will be subtracted from the total of the game player who tossed the game bag. As illustrated, the target walls 30 are staggered in relation to the target walls 20, 22 and 24. By varying the force and trajectory in which the game bag is pitched, the game bag may be pitched so that it will land just in front of the target wall 24 or in front of some other target wall depending upon the trajectory of the game bag and whether it bounces straight or sideways when it hits or skids along the planar upper surface of the target board will determine the final resting place of the game bag and determine the points scored by the game player. After the game player has accumulated a certain number of points, the game will be declared over and the game player who accumulated the necessary number of game points declared the winner.

Figure 4:
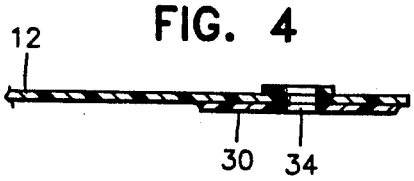
FIG. 4 is a fragmental vertical sectional view taken along section line 4—4 on FIG. 3 illustrating anchor holes provided in the target board.

The corners of the panel 12 are provided with apertures 34 by which the target board can be anchored to a supporting surface 13. The apertures 34 may be reinforced by a grommet structure or extra layers of thickness 36 as illustrated in FIG. 4 in order that a anchoring peg, nail, or the like may be unitized to anchor the target board in a desired location to maintain it in the desired location even though it is impacted on its upper surface by a plurality of pitched game bags 14. Also, a plurality of drain holes 38 are provided generally along the center line of the target board and adjacent the indicia 28 to enable any rain or water that may collect on the upper surface of the target board to drain downwardly through the target board thus enabling it to be effectively used outdoors.

The end edge of the target board adjacent the target wall 24 is provided with an elongated slotlike opening 40 which may serve as a hand hold and also serve to support the target board in a vertical position such as on a projecting hook or nail to enable the target board to be easily stored in a vertical position along side of a wall or the like.

It is desirable that the supporting surface 13 and the upper surface of the target board 10 be substantially level in order to provide the best possible target characteristics for the pitched bags. The target board may have a rubber backing or rubber pad attached thereto to help to anchor it in place along with the anchor holes which are especially useful when positioning the target board outdoors on grass, dirt surfaces and the like. When pitching bags from one target board toward another, the players should stand alongside of the pad with the leading foot not extending beyond the front of the pad or target board. The pitching bags may be constructed of leather, plastic, fabric or other flexible material with each player preferably being provided with two bags with the pair of bags for each player being distinguishable colored for identification. The three centrally located targets 20, 22 and 24 have progressively valued point scores and the out of bounds target areas 30 have minus point values. The distance from which players pitch the bags may vary depending upon the age of the players and the physical strength and dexterity of the players. This device may be used by children of various ages, students, senior citizens, nursing home occupants, wheelchair occupants and the like with the rules of the game being varied to accommodate the various players. The game can be played on driveways, sidewalks, in basements, recreation rooms and on substantially any flat surface indoors or outdoors. Each of the target areas or walls are arcuate in configuration when viewed from the top and the top edge of each of the target walls is arcuate with the high point being at the center and the side edges curving downwardly to merge and join with the upper surface of the panel 12. The bag may be filled with sand such as fine plaster sand having a weight of 6 or 7 ozs. Although this can be varied, the bags may be oval shaped and approximately 4" by 3" in length and width. The bags are sufficiently flexible and sufficiently light in weight to prevent injury in the event they come into contact with one of the game players.

The foregoing is considered as illustrative only of the principles of the invention. Further, since numerous modifications and changes will readily occur to those skilled int he art, it is not desired to limit the invention to the exact construction and operation shown and described, and, accordingly, all suitable modifications and equivalents may be resorted to, falling within the scope of the invention.

I claim:

1. A game device comprising a target pad and at least one pitching bag to be tossed toward said pad for scoring points when the bag comes to rest on particular areas of said pad, said pad comprising a generally rectangular planar upwardly facing surface, a plurality of spaced upwardly projecting targets on said surface, each of said targets including an arcuately curved member having a concave, generally vertically extending surface facing an edge of said pad, said pitching bag comprising a flexible cover enclosing a quantity of granular material to enable the bag to be tossed onto the pad without substantial rebound with points being scored when the bag comes to rest adjacent the concave surface of one of said targets on the pad, certain of said targets being arranged in longitudinally spaced relation along the center line of said pad with the height of the arcuately curved members increasing progressively from one edge of said pad to increase the degree of difficulty of a bag coming to rest in front of a particular arcuate member, and score indicating indicia adjacent each of the target members along the center line with the score value increasing with the degree of difficulty and the height of the target members.

2. The game device as defined in claim 1 together with additional targets along side edge portions of said pad to indicate out of bounds pitches of the bag with negative value points being scored when a pitched bag lands in front of one of the target members adjacent a side edge portion of the pad.

3. The game device as defined in claim 2 together with means anchoring the pad on a support surface, said anchoring means including anchoring holes adjacent each corner of the pad.

4. The game device as defined in claim 2 together with drain holes in said pad in front of the target members to drain water from the upper surface of the pad to enable effective use of the pad outdoors.

5. The game device as defined in claim 2 together with an elongated opening in an end edge of the pad forming a hand hold and a structure for hanging the pad from a vertical support structure when stored.

* * * * *